US008671704B2

(12) United States Patent
Zimmermann et al.

(10) Patent No.: US 8,671,704 B2
(45) Date of Patent: Mar. 18, 2014

(54) REFRIGERATION SYSTEM WITH INTERMEDIATE PRESSURE VAPOR SUPPLY VALVE

(75) Inventors: Augusto Jose Pereira Zimmermann, Gaspar-SC (BR); Gustavo Portella Montagner, Florianopolis-SC (BR); Joaquim Manoel Goncalves, São José-SC (BR)

(73) Assignees: Whirlpool S.A., San Pablo (BR); Universidade Federal de Santa Catarina (UFSC), Autarquia Federal de Regime Especial, Florianopolis (BR)

( * ) Notice: Subject to any disclaimer, the term of this patent is extended or adjusted under 35 U.S.C. 154(b) by 673 days.

(21) Appl. No.: 12/737,435

(22) PCT Filed: Jun. 15, 2009

(86) PCT No.: PCT/BR2009/000170

§ 371 (c)(1),
(2), (4) Date: Feb. 15, 2011

(87) PCT Pub. No.: WO2009/152593

PCT Pub. Date: Dec. 23, 2009

(65) Prior Publication Data

US 2011/0197606 A1 Aug. 18, 2011

(30) Foreign Application Priority Data

Jun. 18, 2008 (BR) ..... 0802382

(51) Int. Cl.
*F25B 41/04* (2006.01)

(52) U.S. Cl.
USPC ..... 62/218; 62/157; 62/197; 62/198; 62/509; 62/512

(58) Field of Classification Search
USPC ..... 62/117, 157, 197, 198, 218, 509, 512, 62/513
See application file for complete search history.

(56) References Cited

U.S. PATENT DOCUMENTS

| | | | | |
|---|---|---|---|---|
| 5,431,026 | A | 7/1995 | Jaster | 62/221 |
| 5,816,055 | A * | 10/1998 | Ohman | 62/117 |
| 2008/0098754 | A1 | 5/2008 | Sommer et al. | 62/115 |

FOREIGN PATENT DOCUMENTS

| | | |
|---|---|---|
| DE | 278095 | 9/1914 |

* cited by examiner

*Primary Examiner* — Marc Norman
*Assistant Examiner* — Jonathan Bradford
(74) *Attorney, Agent, or Firm* — Harrington & Smith

(57) ABSTRACT

A refrigeration system includes a compressor; a condenser connected to a first inlet of a separator which has: a vapor outlet connected to the compressor and a liquid outlet connected to an evaporator; a selecting valve having: a first vapor inlet connected to the evaporator; a second vapor inlet connected to the separator; and a vapor outlet connected to the compressor, the selecting valve being operated to selectively and alternatively communicate its first and second vapor inlets with its vapor outlet, so as to allow the compressor to draw vapor from the separator and from the evaporator; and a control unit for controlling the operation of the selecting valve.

5 Claims, 2 Drawing Sheets

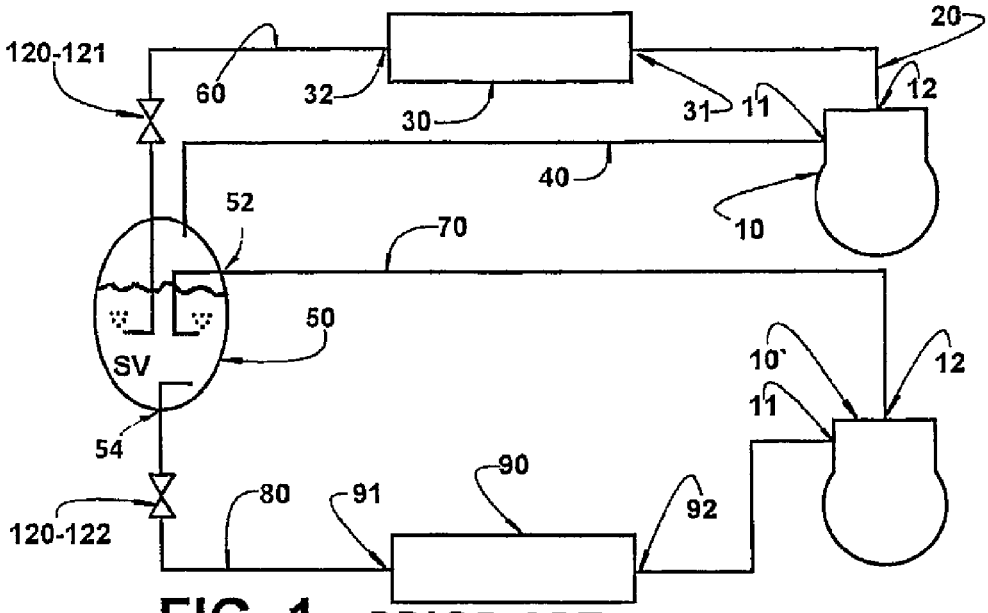
FIG. 1 – PRIOR ART
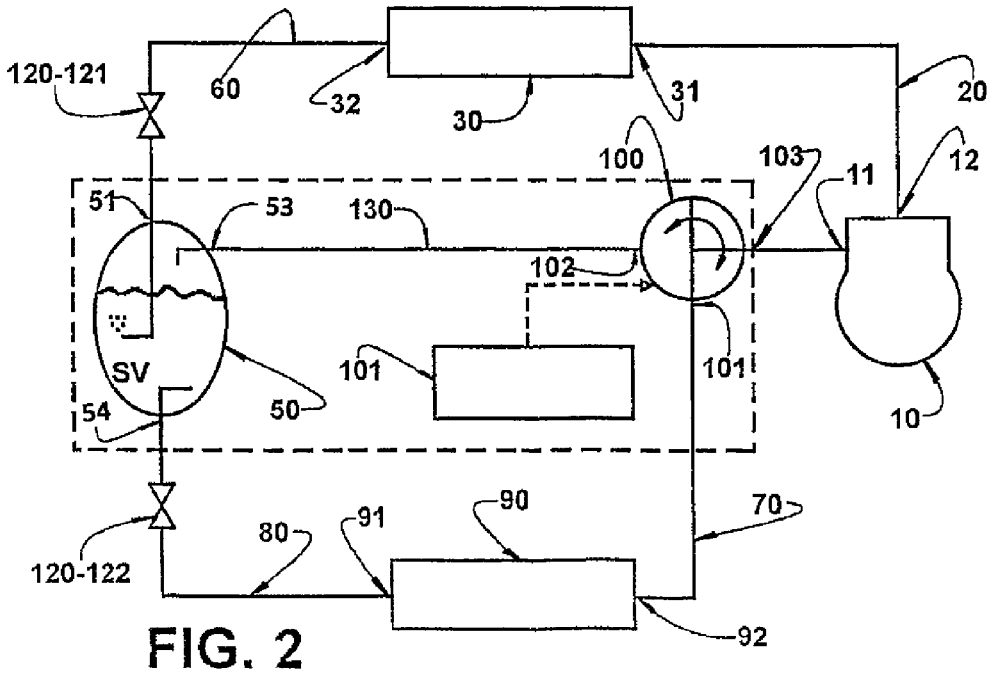
FIG. 2

REFRIGERATION SYSTEM WITH INTERMEDIATE PRESSURE VAPOR SUPPLY VALVE

FIELD OF THE INVENTION

The present invention refers to a refrigeration system by mechanical compression of vapor in which the compressor draws refrigerant fluid through a circuit with at least two suction pressure stages. The present refrigeration system can be applied to any type of refrigerant fluid, such as, for example, those containing carbon in their constitution.

BACKGROUND OF THE INVENTION

The refrigeration systems by mechanical compression of vapor are based on the principle of refrigeration obtained by evaporation of a volatile fluid when submitted to a pressure reduction and are used in most modern applications, since their conception (Gosney; W. B., 1982, Principles of Refrigeration, Cambridge University Press), even with the existence of several other principles of refrigeration, such as: thermoelectric, Stirling, electro-caloric, and the like. The initial development of the refrigeration systems aimed at obtaining safe (non-toxic and non-inflammable) refrigerant fluids, and at adapting their reliability and operational characteristics for general use, as is the case of the household hermetic refrigeration systems initially available around 1930 (Nagengast; B. A., 1996, History of sealed refrigeration systems, ASHRAE Journal 38(1): S37, S38, S42-S46, and S48, January).

Regarding the adoption of a safe refrigerant fluid and the improvement of the energetic efficiency of these systems, the use of carbon dioxide ($CO_2$) as a refrigerant fluid should be pointed out.

In the conventional refrigeration systems, during operation of the compressor, the refrigerant fluid comprises, in the evaporator inlet, a vapor part which is small in mass but large in volume, and a liquid part which is small in volume and large in mass. This vapor, which is present in the evaporator inlet during the expansion process, upon passing through said evaporator, does not effect heat exchange, reducing heat transfer efficiency and thus generating a certain inefficiency of the refrigeration system, since the compressor consumes energy to move this refrigerant fluid along the whole evaporator and, afterwards, to compress it, without said refrigerant fluid in vapor form carrying out heat exchange. The compressor, therefore, consumes energy to compress this vapor, from the low pressure to the discharge pressure.

The refrigerant fluid in vapor form in the evaporator inlet actuates as a vapor fraction to be continuously drawn and pumped, without producing refrigeration capacity, but with energy consumption in the compressor. In some known prior art solutions, this energetic loss is minimized through a refrigeration system using a vapor separator in the refrigeration circuit to effect extraction of this vapor, so as to provide, to the circuit, a more efficient expansion process of refrigerant fluid by stages.

The use of multiple compression stages, initially called Windhausen refrigeration system (Windhausen; F., 1901, "Improvements in carbonic anhydride refrigerating machine" British Patent GB9084 of 1901), considerably improves the energetic efficiency of the refrigeration cycle, mainly for applications with great temperature difference (higher than 60° C.) between hot and cold environments, specially for some refrigerant fluids as carbon dioxide and ammonia (Kim; M. H., Pettersen; J., Bullard; C. W., 2004, Fundamental process and system design issues in CO2 vapor compression systems, Progress in Energy and Combustion Science, 30 (2004) pp. 119-174).

Cycles of multiple compression stages and with ammonia as the refrigerant fluid have been widely used in industrial refrigeration installations (Stoecker; W. F., 2001, Handbook of Industrial Refrigeration, Business News Publishing Co.), as schematically illustrated in FIG. 1 of the enclosed drawings, which require the presence of two compressors 10, 10' in the refrigeration circuit.

In such refrigeration systems, a first compressor 10 presenting an inlet 11 and an outlet 12 of refrigerant fluid in vapor form, has its outlet 12 connected, by a first vapor duct 20, to a condenser 30 (gas cooler).

The condenser 30 presents a vapor inlet 31 connected to the outlet 12 of the compressor 10 and a liquid outlet 32 connected, through an expansion device 120, particularly a high-expansion device 121 in the form of a valve, by a condensate duct 60, to a first inlet 51 of a separating means 50 (expansion or flash vapor separator).

The separating means 50 further presents: a second vapor inlet 52 connected, by a duct 70 where is mounted the second compressor 10', to an evaporator 90 operatively associated with a medium M to be cooled; a vapor outlet connected to the inlet 11 of the compressor 10, through a second vapor duct 40; and a liquid outlet 54 connected, by a liquid duct 80, to an inlet of an expansion device 120, particularly a low-expansion device 122 in the form of a valve connected to the evaporator 90.

The evaporator 90 presents a vapor-liquid mixture inlet 91 connected, through the liquid duct 80, to the high-expansion device 121 and a vapor-liquid mixture outlet 92 connected, through the duct 70, to the second inlet 52 of the separating means 50, through the second compressor 10'.

The low-expansion device 122 and high-expansion device 121 are disposed in the refrigeration system circuit, so as to provoke a determined pressure condition in the separating means 50, establishing differentiated pressure levels previously defined for the adequate operation of the refrigeration system. Such expansion devices 120, whether low-expansion device 122 or high-expansion device 121, can have the form of a fixed restriction orifice, such as a capillary tube or a restricting valve, of variable flow or not, such as an electronic control valve commanded by a control unit, so as to vary the degree of restriction of the refrigerant fluid flow, in the refrigeration circuit.

In another known refrigeration solution using double-stage pressure, (Voorhees; G., 1905, Improvements relating to systems of fluid compression and the compressors thereof, British Patent GB4448 of 1905; and Lavrechenko; G. K., Zmitrochenko; J. V., Nesterenko; S. M. and Khmelnuk; G. M., 1997, Characteristics of Voorhess refrigerating machine with hermetic piston compressor producing refrigeration at one or two temperature levels, International Journal of Refrigeration, 20-7 (1997) 517-527) the refrigeration circuit presents a double-suction compressor, in which a supplementary suction orifice is opened during the suction stroke of the compressor, which allows the refrigerant to be drawn in two suction pressure levels.

In this construction, the compressor starts the suction from the evaporator and, in a determined stage of the suction stroke, the motion of the piston opens an orifice provided in the compressor and which allows the vapor, in an intermediary pressure between the suction and discharge pressures, to be injected into the cylinder, so that the start of the compression process occurs at a pressure higher than the evaporation pressure.

Another known refrigeration solution using a double-stage pressure cycle (Plank; R., 1912, Arbeitsverfahren an Kompressionskälternaschinen, insbesondere für Kälteträger mit tiefer kritischer Temperatur, German Patent DE278095) uses a pumping stage close to the expansion valve. The last step of cooling the compressed fluid reduces substantially the enthalpy before the expansion, thus increasing the refrigeration capacity. Due to the high refrigerant density in the second stage of compression (pumping), the power required is low, being almost comparable with the power of a liquid pump.

It is also known a double-stage system (initially proposed in 1931) which uses an ejector to carry out the suction of the low-pressure stage in the evaporator (Disawas; S., Wongwises; S., 2004, Experimental investigation on the performance of the refrigeration cycle using a two-phase ejector as an expansion device, International Journal of Refrigeration, 27 (2004) 587-594; and Butrimowicz; D., Karwacki; J., Trela; M., 2005, Investigation of two-phase ejector in application to compression refrigeration systems, IIR (Int. Inst. of Refrigeration) International Conference, Vicenza-Italy, Pre-prints, pp. 695-702).

The refrigeration systems which present multiple suction pressure stages are especially interesting when working with refrigerant fluid such as $CO_2$ and ammonia. The use of systems with multiple suction pressure stages sensitively improves the efficiency of the refrigeration system for these refrigerant fluids, since it eliminates the admission of the expansion vapor into the evaporator. In this case, the expansion vapor is separated and drawn by the compressor at an intermediary pressure.

The refrigerant fluid in vapor state which is present in the refrigeration circuit is also conducted to the compressor suction, but at an intermediary pressure between the suction and discharge pressures, being drawn by the compressor jointly with the refrigerant fluid in the vapor form and at a low pressure.

Although these known refrigeration systems of multiple pressure stages reduce the energetic losses in relation to the conventional refrigeration systems, they require a complex and frequently costly construction, due to the need of a differentiated compression for the low-pressure vapor and for vapor at a higher pressure, requiring either duplicating the compressor quantity, in a single body or not, or the provision of elements in the refrigeration circuit which can change the pressure of the vapor which is present in the circuit and to be pumped jointly with the low-pressure vapor.

OBJECTS OF THE INVENTION

It is an object of the present invention to provide a refrigeration system of a simple construction with a relatively low cost in relation to the refrigeration systems of multiple pressure stages, eliminating the need for multiple compressors. Thus, the amount of refrigerant fluid in the form of expansion vapor (or flash vapor) is reduced and its pressure is raised when the compressor pumps it from the evaporation pressure level in the evaporator outlet to the discharge pressure of the compressor, thus reaching a higher energetic efficiency of the compressor.

Another object of the present invention is to provide a system such as cited above and which need not change the characteristics of neither the compressor nor the evaporator of the refrigeration system.

An additional object of the present invention is to provide a system of the type cited above and which allows obtaining a considerable improvement in the thermal yield of the refrigeration system and cost reduction, particularly in the case of refrigerant fluids as the $CO_2$.

SUMMARY OF THE INVENTION

The above-cited and other objects of the present invention are attained by the provision of a refrigeration system comprising: a compressor having an inlet and an outlet of refrigerant fluid in vapor form; a condenser (or "gas cooler") having a vapor inlet connected to the outlet of the compressor and a liquid outlet; a high expansion device having an inlet connected to the liquid outlet of the condenser and an outlet; a separating means having a first inlet connected to the liquid outlet of the condenser and a vapor outlet connected to the inlet of the compressor, and a liquid outlet; a low expansion device having an inlet connected to the liquid outlet of the separating means and an outlet; an evaporator having a vapor-liquid mixture inlet receiving refrigerant fluid from the separating means through the low-expansion device outlet and a vapor-liquid mixture outlet; a selecting valve having: a first vapor inlet connected with the vapor-liquid mixture outlet of the evaporator; a second vapor inlet connected to the vapor outlet of the separating means; and a vapor outlet connected to the inlet of the compressor, said selecting valve maintaining the refrigerant fluid in the second vapor inlet of the selecting valve and in the interior of the separating means, at a first suction pressure superior to a second suction pressure reigning in the first vapor inlet of the selecting valve and in the vapor outlet of the evaporator, and being operated to selectively and alternatingly communicate its first and second vapor inlets with its vapor outlet, so as to allow the compressor to draw refrigerant vapor from the separating means, at said first suction pressure, and refrigerant vapor from the evaporator, at said second suction pressure; and a control unit operatively associated with the selecting valve, so as to operate the latter to maintain the level of the liquid refrigerant fluid in the interior of the separating means within predetermined values.

The construction proposed by the present invention allows not only separating the vapor inside the separating means, making only the liquid refrigerant fluid be directed to the evaporator, but also allowing the vapor contained in the interior of the separating means to be selectively drawn by the compressor, in a respective operational condition of the selecting valve and at an intermediary pressure which is higher than that reigning in the evaporator outlet and lower than that of the discharge pressure of the compressor, requiring less energy consumption to return this gaseous part of the refrigerant fluid to the high-pressure side of the refrigeration circuit.

BRIEF DESCRIPTION OF THE DRAWINGS

The invention will be described below, with reference to the enclosed drawings, given by way of example of an embodiment of the invention and in which:

FIG. 1 schematically represents a prior art refrigeration system presenting a double-stage suction with two compressors;

FIG. 2 schematically represents a refrigeration system constructed according to the present invention.

DESCRIPTION OF THE ILLUSTRATED EMBODIMENTS

Figure 3:
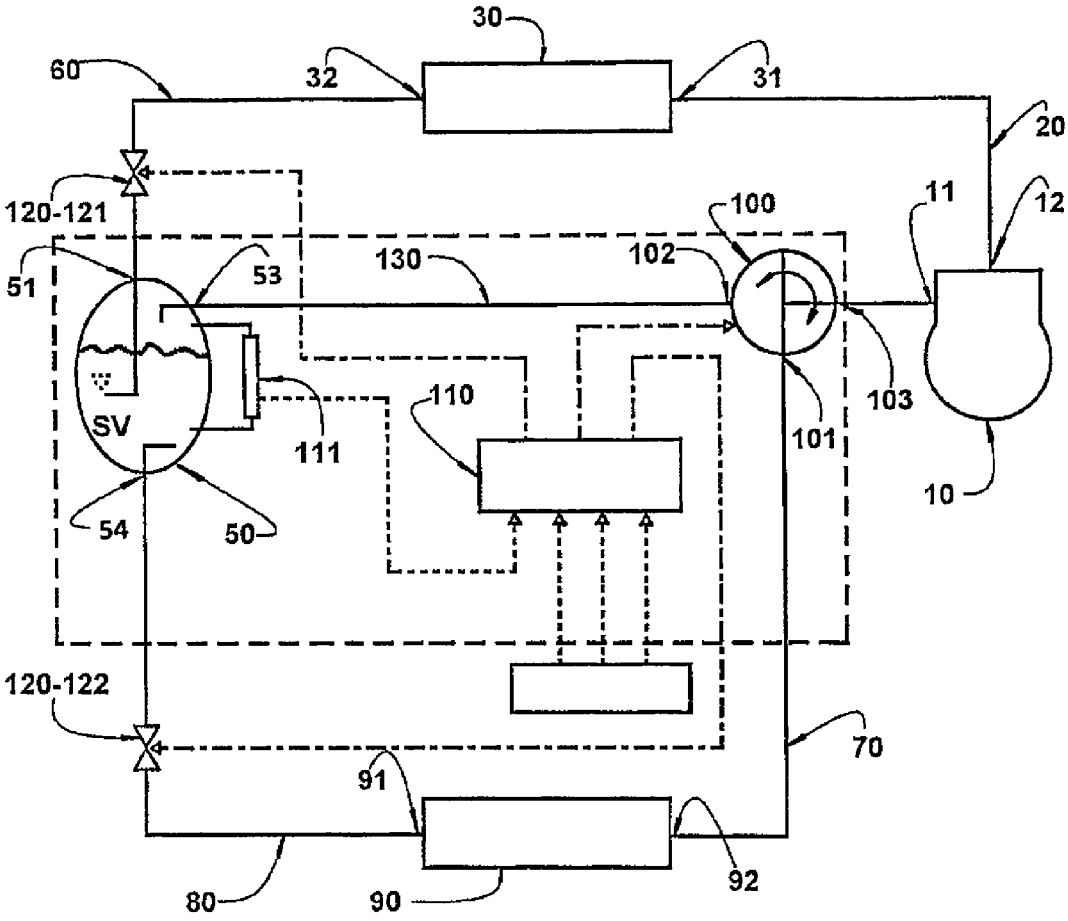
FIG. 3 schematically represents another construction for the refrigeration system of the present invention, but presenting controls of higher level.

The present invention will be described for a refrigeration system of the type which operates by double-stage mechanical compression of vapor, said refrigeration system comprising, as illustrated in FIGS. 2 and 3: a single compressor 10 presenting an inlet 11 and an outlet 12 of refrigerant fluid in the vapor form, said outlet 12 being connected to the condenser 30, as already previously described for the refrigeration system illustrated in FIG. 1. The refrigeration system components and their connections illustrated in FIGS. 2 and 3, which are the same as those of the refrigeration system illustrated in FIG. 1, present the same reference numbers and will not be described again herein.

In the constructions illustrated in FIGS. 2 and 3, the liquid outlet 32 of the condenser 30 is connected, through the condensate duct 60, to an inlet of the high-expansion device 121, which presents an outlet connected to the first inlet 51 of the separating means 50.

The separating means 50 in the construction of the present invention illustrated in FIGS. 2 and 3, does not present the second inlet 52 which, in the prior art, connects the evaporator 90 to said separating means 50, as described below.

According to the present invention, the refrigeration system further comprises a selecting valve 100 (or sequence deviation valve) having: a first vapor inlet 101 connected with the vapor-liquid mixture outlet 92 of the evaporator 90; a second vapor inlet 102 connected to the vapor outlet 53 of the separating means 50; and a vapor outlet 103 connected to the vapor inlet 11 of the compressor 10, through the second vapor duct 40, said selecting valve 100 maintaining the refrigerant fluid in the second vapor inlet 102 of the selecting valve 100 and in the interior of the separating means 50 at a first suction pressure, superior to a second suction pressure reigning in the first vapor inlet 101 of the selecting valve 100 and in the vapor-liquid mixture outlet 92 of the evaporator 90, and being operated to selectively and alternatingly communicate its first and second vapor inlets 101, 102 with its vapor outlet 103, so as to allow the compressor 10 to draw refrigerant vapor from the separating means 50, at said first suction pressure, and refrigerant vapor from the evaporator 90, at said second suction pressure; and a control unit 110 operatively associated with the selecting valve 100, so as to operate the latter to reduce the admission of vapor in the evaporator 90, through the liquid outlet 54 of the separating means 50, and to make the vapor coming from the separating means 50 be compressed at a compression rate lower than that if it had been submitted to a pressure reigning at the evaporator 90, through the vapor outlet 53 of the separating means 50. Although not illustrated, the control unit may operate the selecting valve 100 and the expansion devices 120 through, for example, actuating means.

The assembly defined by the separating means 50 and the selecting valve 100 (and also the ducts connecting these elements to each other and to other parts of the refrigeration circuit operatively associated therewith) defines a double-stage emulator (said assembly being illustrated in dashed line in FIGS. 2 and 3).

The operation of the selecting valve 100, alternating the connection of its first and second vapor inlets to the suction of the compressor 10, is carried out in communication or commutation periods of time, for each said connection, proportional to the refrigeration system capacity or size, so that the smaller refrigeration systems will have a faster switching, whilst in greater refrigeration systems this switching is slower.

The selecting valve 100 further presents the functions of: reducing the supply of vapor in the evaporator 90, through the liquid outlet 54 of the separating means 50; and allowing the vapor drawn by the compressor 10 and which is coming from the separating means 50 to be compressed at a compression rate, that is, at a ratio between the pressure reigning in the inlet 11 of the compressor 10 and the pressure reigning in the outlet 12 of said compressor 10, i.e., at a compression rate much smaller than that when the vapor is drawn from the evaporator 90, spending less energy.

In refrigeration systems in which the operation conditions do not vary much, the switching of communication between the suction from the evaporator 90 and the suction from the separating means 50 to the vapor inlet 11 of the compressor 10, through the selecting valve 100, can be carried out by command of the control unit 110, in a predetermined and constant form, for example, as a function of the pre-established communication (or switching) time intervals, making the control easy to be implemented at a low cost. An example of these systems is illustrated in FIG. 2.

In these cases, the control unit 110 commands the operation of the selecting valve 100 from fixed communication time intervals between each one of the first and second vapor inlets 101, 102 and the vapor outlet 103 of the selecting valve 100, the communication time of the first vapor inlet 101 with the vapor outlet 103 being inferior to the communication time of the second vapor inlet 102 with said vapor outlet 103 of the selecting valve 100.

For this switching operation with fixed commutation times, the control unit 110 comprises a timer which determines the communication times between each of the first and second vapor inlets 101, 102 of the selecting valve 100 with the vapor outlet 103 of the latter. In this construction, the communication time between the first and the second vapor inlets 101, 102 of the selecting valve 100 with the outlet de vapor 103 of the latter is constant and previously defined from the constructive characteristics of the refrigeration system, such as refrigerating capacity and thermal load, simplifying the command circuit and reducing the component costs.

For the refrigeration systems presenting variable operational conditions, the control unit 110 considers at least one variable parameter existing in the refrigeration system and/or also the refrigeration conditions of the medium to be cooled and to which said refrigeration system is coupled.

In this case, the control unit 110 commands the operation of the selecting valve 100 from variable communication times alternated between each of the first and second vapor inlets 101, 102 and the vapor outlet 103 of said selecting valve 100, said communication times being defined from at least one operational condition associated with the components of the refrigeration system and/or with the environment external to the latter.

In the constructions (FIG. 3) in which the liquid level is a determining factor for selecting the connection of the first or second vapor inlet 101, 102 to the vapor outlet 103 of the selecting valve 100, the present refrigeration system comprises a level sensor 111 operatively associated with the control unit 110, so as to constantly or periodically inform the latter about the liquid level in the interior of the separating means 50, said level sensor 111 being capable of detecting predetermined maximum and minimum values of the liquid refrigerant fluid level in the interior of the separating means 50. It should be observed that the provision of a level sensor 111 is not compulsory, such provision being a constructive option in case the operation of the selecting valve 100 occurs as a function of variable parameters controlled by the control unit 110, such as in the construction of FIG. 3.

In the constructions in which the communication times are fixed, the control unit 110 can command the operation of the selecting valve 100 based on the information received from said level sensor 111, which operates as a safety means of the refrigeration system. The present invention can present different levels of sophistication for the control unit 110, which are: as illustrated by FIG. 2, the commutation times can be fixed; or by monitoring the liquid level in the separating means 50 and other parameters of the refrigeration system, or also of the environment associated therewith (pressure, vapor and/or liquid amount in the separating means 50, temperature in the medium M to be cooled, temperature of the environment in which the condenser 30 and the compressor 10 are physically placed, temperature thereof, compressor motor operating frequency, etc.), as illustrated in FIG. 3. The control unit 110 will command the selective switching of the first and second vapor inlets 101, 102 of the selecting valve 100, as a function of determined values previously established as reference for the control parameters to be considered.

In the situations in which the control unit 110 operates with more than one variable to determine the commutation times of the vapor inlets 101, 102 of the selecting valve 100 to the vapor outlet 103 of the latter, there is a previous determination for the priority of these variables and conditions of predominance thereof in the operation control of the selecting valve 100, so that the refrigeration system operation is not impaired in determined anomalous situations associated with one or other of the variables. In these cases, the non-dominant variables are considered as safety variables, guaranteeing minimizing risk situations and malfunction of the refrigeration system.

It should be understood that the present description exemplifies a possible operation of the control unit 110, which alternates the connection between the vapor inlets 101, 102 to the vapor outlet 103 of the selecting valve 100. Therefore, said operation, which considers the presence or not of sensor means and other means to determine the operation of the selecting valve 100, should not be considered as limiting the concept of the present invention. In the concept presented herein, the control unit 110 actuates on the selecting valve 100, so as to allow only one compressor 10 to alternatively draw vapor from the separating means 50 and from the evaporator 90. The control unit 100 allows the selective switching of the communication of each of the vapor inlets 101, 102 to the vapor outlet 103 of the selecting valve 100, maintaining the suctions from the separating means 50 and from the evaporator 90 at different pressures. This switching can be made in fixed or variable communication times, in order to provide a better stability of the control variables, apart from those related to a better reliability of the refrigeration system in determined specific situations detected by sensor means.

As already described in FIG. 1, the low-expansion device 122 and the high-expansion device 121 in the refrigeration system of the present invention can have the form of a fixed restriction orifice, such as a capillary tube or a restricting valve with variable flow or not, such as an electronic control valve commanded by the control unit 110, said low-expansion device 122 and high-expansion device 121 being operatively associated with the control unit 110 so as to be commanded by the latter to vary the degree of restriction in the refrigerant fluid flow in the refrigeration circuit. Said degree of restriction is defined as a function of the need to control the pressures in the refrigeration system, which restriction is determined by the suction pressure required by the compressor 10, when the selecting valve 100 communicates the separating means 50 to said compressor 10.

Some of the advantages of the present invention are: reducing considerably the flash vapor in the evaporator inlet 90, which vapor must be eliminated or at least minimized, as it is a "parasite" that must be removed from the evaporator before admitted therein, since said vapor, upon passing through the evaporator, causes harm by not effecting heat exchange. By using the separating means 50, the generation of flash vapor is minimized in the second expansion device between the separating means 50 and the evaporator 90, which vapor is prevented from passing through the evaporator 90. Furthermore, the flash vapors in the separating means 50 are compressed by the compressor 10, when the second vapor inlet 102 of the selecting valve 100 is connected to the vapor outlet 103 thereof, at an intermediary pressure which is superior to that of the evaporator 90 and inferior to that of the compressor discharge, requiring less work and consuming less energy of said compressor for pumping it back to the condenser 30 of the refrigeration system, this pumping occurring until the selecting valve 100 is instructed to operate the fluid communication between its second vapor inlet 102 and its vapor outlet 103.

The present invention also provides, as a benefit, the possibility of controlling the pressures existing in different levels established in the system: pressure in the condenser 30 (or "gas-cooler"); pressure in the separating means 50; and pressure in the evaporator 90. The control of the pressure levels and the possibility of compressing the vapor from the separating means 50 with a smaller compression rate provide economy in the consumption of energy to carry out the present process, which is different from the prior art processes by reducing the number of compressors.

A possible constructive option for the present invention provides the integration of the selecting valve 100 (or sequence deviation valve) to the compressor 10. This integration aims at obtaining considerable gains of thermal yield for the system, due to the reduction of the dead volume relative to the presence of the second vapor duct 40 in the circuit. This possibility of integration is also interesting in terms of construction, drive, control, and even cost of the device proposed.

Although the concept presented herein has been described mainly considering the illustrated circuit and evaporator constructions, it should be understood that these particular constructions do not imply any restriction to the applicability of the present invention; what is intended to protect is the principle and not only a specific application or a particular constructive form.

The invention claimed is:

1. A refrigeration system, comprising:

a compressor having an inlet and an outlet of refrigerant fluid in vapor form;

a condenser having a vapor inlet connected to the outlet of the compressor and a liquid outlet;

a high-expansion device having an inlet connected to the liquid outlet of the condenser and an outlet;

a separating means having a first inlet connected to the liquid outlet of the condenser and a vapor outlet connected to the inlet of the compressor and a liquid outlet;

a low-expansion device having an inlet connected to the liquid outlet of the separating means and an outlet;

an evaporator having a vapor-liquid mixture inlet receiving refrigerant fluid from the separating means through the outlet of the low-expansion device and a vapor-liquid mixture outlet; and a selecting valve having: a first vapor inlet connected with the vapor-liquid mixture outlet of the evaporator; a second vapor inlet connected to the vapor outlet of the separating means; and a vapor outlet connected to the inlet of the compressor, said selecting valve maintaining the refrigerant fluid in the second vapor inlet of the selecting valve and in the interior of the separating means at a first suction pressure higher than a second suction pressure in the first vapor inlet of the selecting valve and in the vapor outlet of the evaporator and being operated to selectively and alternatingly communicate the first and second vapor inlets of the selecting valve with the vapor outlet of the selecting valve, so as to allow the compressor to draw refrigerant vapor from the separating means, in said first suction pressure, and refrigerant vapor from the evaporator, in said second suction pressure; and a control unit operatively associated with the selecting valve, so as to operate the selecting valve for maintaining the level of the liquid refrigerant fluid in the interior of the separating means within predetermined values.

2. The system, as set forth in claim 1, characterized in that the control unit comprises a timer which determines communication times between each of the first and second vapor inlets of the selecting valve and the vapor outlet of the latter, said communication times being designed to maintain the level of the liquid refrigerant fluid in the interior of the separating means within said predetermined values.

3. The system, as set forth in claim 2, characterized in that the control unit commands the operation of the selecting valve from variable communication times which are switched between the first and second vapor inlets and the vapor outlet of the selecting valve, said communication times being defined from at least one operational condition associated with the components of the refrigeration system and/or with the environment external to the refrigeration system.

4. The system, as set forth in claim 1, characterized in that the control unit commands the operation of the selecting valve from a level sensor capable of detecting predetermined maximum and minimum values of the liquid refrigerant fluid level in the interior of the separating means.

5. The system, as set forth in claim 1, characterized in that the high-expansion device and low-expansion device are operatively associated with the control unit, so as to be commanded by the control unit to vary the degree of restriction in the refrigerant fluid flow and the pressure in the interior of the separating means and of the evaporator.

* * * * *